United States Patent [19]

Bains

[11] 4,262,578

[45] Apr. 21, 1981

[54] CARTRIDGE EJECTOR

[75] Inventor: William R. Bains, Lake Elsinore, Calif.

[73] Assignee: The United States of America as represented by the Secretary of the Army, Washington, D.C.

[21] Appl. No.: 47,595

[22] Filed: Jun. 8, 1979

[51] Int. Cl.[3] ..... F41D 11/00

[52] U.S. Cl. ..... 89/1 K; 42/25

[58] Field of Search ..... 42/25; 89/1 K, 33 F

[56] References Cited

U.S. PATENT DOCUMENTS

| | | | |
|---|---|---|---|
| 713,623 | 11/1902 | Evans | 42/25 |
| 3,512,449 | 5/1970 | Stoner | 89/169 |
| 3,630,118 | 12/1970 | Stoner | 89/33 C |

*Primary Examiner*—Stephen C. Bentley

*Attorney, Agent, or Firm*—Peter A. Taucher; John E. McRae; Nathan Edelberg

[57] ABSTRACT

A cartridge ejector for a recoil-operated gun. In prior art guns of the recoil-operated type if the gun fails to fire the lack of recoil force prevents the gun from continuing to fire. To allieviate this situation a manually-controlled charging mechanism is operated to draw the bolt carrier back to the full recoil position. Under the present invention the charging mechanism is augmented by a spring-urged piston that propels a special striker arm against the ejector rod carried by the bolt assembly. The ejector rod forcibly impacts the base of the ufired cartridge to eject it from the gun.

6 Claims, 4 Drawing Figures

CARTRIDGE EJECTOR

The invention described herein may be manufactured, used, and licensed by or for the Government for governmental purposes without payment to me of any royalty thereon.

BACKGROUND AND SUMMARY OF THE INVENTION

U.S. Pat. No. 3,512,449 issued in the name of E. M. Stoner discloses a recoil-operated gun wherein each spent cartridge is ejected out of the gun as the bolt carrier nears its full recoil position. The bolt assembly includes an ejector rod whose forward end abuts against the base of a cartridge that has been extracted from the firing chamber. As the bolt carrier moves rearwardly the ejector rod strikes the front face of a spring-cushioned buffer, thereby causing the rod to push the cartridge out of the gun. When the gun is operating normally the explosions associated with gun firing give the bolt carrier a high velocity in the recoil direction; therefore the ejector rod is given sufficient impact by the buffer to satisfactorily eject the spent cartridge. However, when the gun fails to fire a round there is no recoil velocity. A manually-controlled charging mechanism is provided to achieve motion of the bolt carrier in the recoil direction. As shown in U.S. Pat. No. 3,512,449, the charging mechanism comprises a hand crank-operated sprocket for moving a chain along the path of the bolt carrier; the chain is connected to a puller that draws the bolt carrier rearwardly when the hand crank is turned. In an effort to provide greater velocity it has been proposed to substitute an electric motor for the hand crank. However, even when a motor is used the bolt carrier velocity does not approach that which is explosively achieved during normal gun firing. Therefore, ejection of unfired ammunition rounds is not completely reliable.

The present invention proposes an auxiliary striker arm arranged in the path of the ejector rod as the charging mechanism moves the bolt carrier rearwardly into engagement with the buffer. A spring-urged piston propels the striker arm forwardly to apply a hammer force on the rear end of the ejector rod, thus causing the rod to eject the unfired cartridge from the gun. The advantage of this arrangement is that the striker force is independent of the rearward velocity of the bolt carrier. Thus, the charging mechanism can be manually-operated or motor-operated at a relatively slow speed without adversely affecting the cartridge-ejecting function.

THE DRAWINGS

Figure 1:
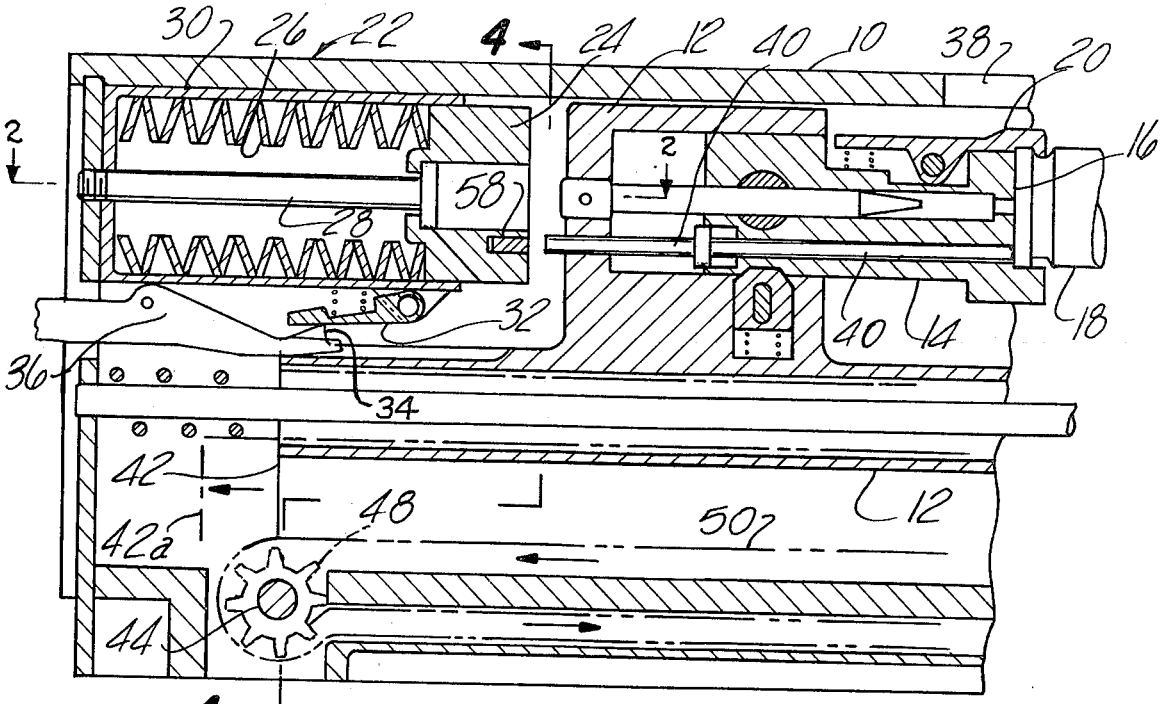
FIG. 1 is a fragmentary longitudinal sectional view taken through a gun adapted to utilize the invention.

The gun system shown in FIG. 1 is structurally and functionally similar to that shown in U.S. Pat. No. 3,512,449. FIG. 1 illustrates only the rear area of the gun; the ammunition feeding mechanism, the barrel and the recoil mechanism (not shown) would be as described in U.S. Pat. No. 3,512,449. Attached FIG. 1 shows a stationary receiver 10 adapted to slidably support a bolt carrier 12 that mounts a shiftable bolt assembly 14. The front face 16 of the bolt constitutes a seating surface for the base of a cartridge 18 that has been extracted from the firing chamber of the gun located to the right of FIG. 1. A swingable extractor claw 20 hooks over the upper side edge of the cartridge to capture and retain the cartridge on bolt 14 during leftward movement thereof in the recoil direction.

In the rear end of receiver there is located a resilient buffer means 22 that includes a plunger 24 biased forwardly by coned spring disks 26; a stop screw 28 limits forward movement of the plunger to the position shown in the drawing. A cup-like housing 30 for the coned spring disks provides a mounting mechanism for a pivotable sear 32 adapted to engage a shoulder 34 on bolt carrier 12, to retain the carrier in the full recoil position. A trigger 36 (operated manually or by non-illustrated solenoid) lifts the sear to its illustrated position during normal firing operations.

Ejection of cartridge 18 through opening 38 in the receiver is accomplished by an ejector rod 40 that is slidably mounted in bolt 14. During normal firing bolt carrier 12 recoils leftwardly to a position wherein its rear end surface 42 momentarily assumes position 42*a*. Incident to such recoil movement an upper portion of the bolt carrier strikes the front face of plunger 24, thereby shifting ejector rod 40 forwardly relative to bolt 14. The forward end of rod 40 applies a striking force to the base of cartridge 18. Assuming a sufficiently high motion imparted to rod 40, the cartridge will be ejected upwardly through opening 38 in receiver 10.

Occasionally the gun fails to fire, in which event the bolt carrier takes a forward position spaced from buffer 22. In order to eject the unfired cartridge and return the bolt carrier to the seared position there is provided a charging mechanism 42. The mechanism includes a rotary shaft 44 attached to a hand crank 46. The shaft carries a sprocket 48 that meshes with a chain 50 extending forwardly to a non-illustrated puller block abutting the front face of bolt carrier 12. Manual rotation of crank 46 translates the chain rearwardly, and thereby returns the bolt carrier to the recoil position. However, the bolt carrier motion is relatively slow so that rod 40 may not exert sufficient force on the base of cartridge 18 to achieve reliable cartridge ejector action.

Figure 2:
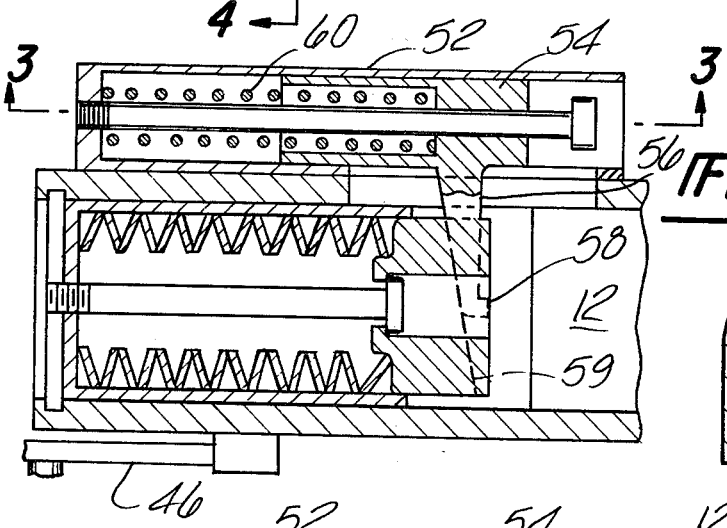
FIG. 2 is a sectional view on line 2—2 in FIG. 1.
Figure 3:
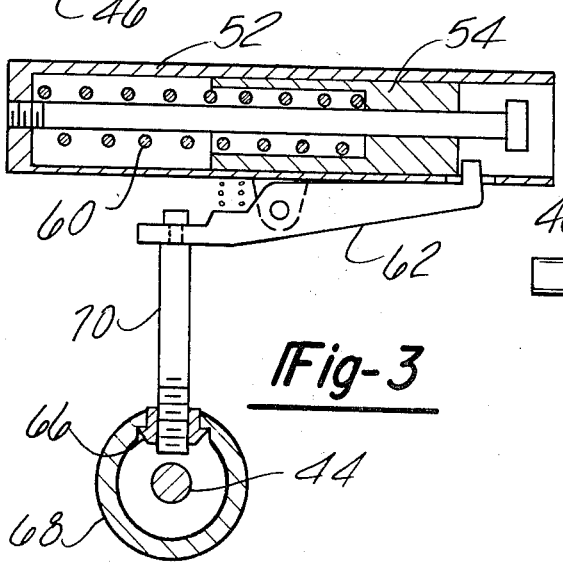
FIG. 3 is a sectional view on line 3—3 in FIG. 2.

The mechanism thus far described is already known, e.g. in U.S. Pat. 3,630,118. The present invention provides auxiliary ejector actuator mechanism shown in attached FIGS. 2 through 4. The mechanism includes a stationary cylinder 52 suitably affixed to receiver 10 for slidable guidance of a piston 54 that carries an ejector rod striker arm 56. The arm extends from the piston through registering slots in cylinder 52 and receiver 10, such that the free end 58 of the arm lies in the path of ejector rod 40; plunger 24 is provided with a transverse slot 59 to accommodate arm 56.

A compression coil spring 60 normally biases piston 54 forwardly against a swingable latch 62 disposed on the underside of cylinder 52. In the latched position of piston 54 the face of striker arm portion 58 lies in the plane of the plunger 24 front face. When the gun is operated normally in the firing mode (single shot or sustained burst) striker arm 56 moves with plunger 24 so that ejector force on rod 40 is proportional to the recoil velocity of bolt carrier 12. The advantage of striker arm 56 occurs when the bolt carrier is operated by hand crank 46. During such time latch 62 becomes disengaged from piston 54, whereupon spring 60 propels the piston and attached arm 56 toward bolt carrier 12.

Figure 4:
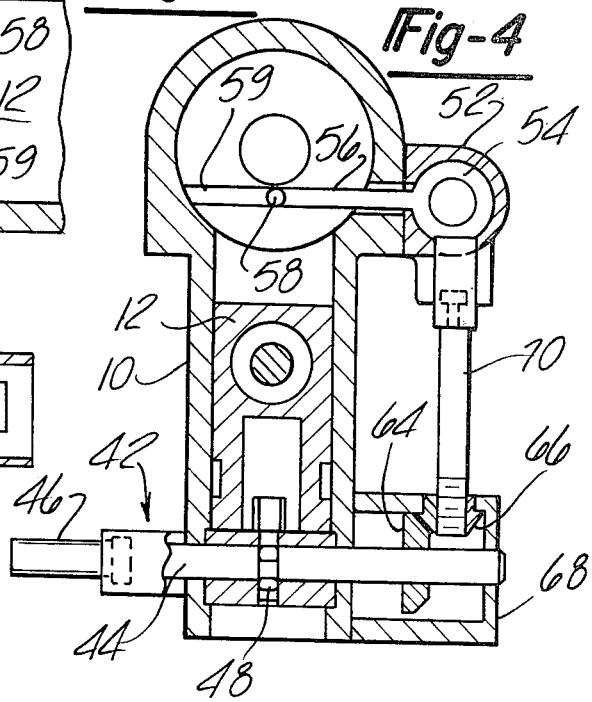
FIG. 4 is a sectional view on line 4—4 in FIG. 1.

As shown best in FIG. 4, shaft 44 carries a first bevel gear 64 that meshes with a second bevel gear 66 journaled in a stationary housing 68. Gear 66 has internal threads that mesh with threads on a push rod 70, whose upper end is linked to the aforementioned latch 62. The rod 70 - latch 62 connection uses a key action such that rod 70 is prevented from rotation. Therefore rotation of bevel gear 66 produces translational motion of rod 70.

The gear diameters and thread pitch are such that by the time crank 46 has been turned to position bolt carrier 12 into close adjacency with plunger 24 the rod 70 will be sufficiently elevated to withdraw latch 62 out of engagement with piston 54. As the latch is released from the piston the stored force in spring 60 propels piston 54 forwardly, thereby causing the end 58 of stroker arm 58 to apply a hammer force on the end of ejector rod 40. The magnitude of the hammer force is proportional to the stored force in spring 60 and independent of the speed of bolt carrier 12. Therefore, a reliable cartridge ejector action is obtainable even though the bolt carrier is operated at a slow or variable speed. The latch-retracting mechanism is preferably set to trigger the latch to the piston-release condition just prior to the instant when rod 40 would reach the face of arm portion 58; the arm therefore is in motion before it strikes the rod.

The latch-retracting mechanism can be varied as to structural detail and positionment. For example, instead of a thread type motion a stepped cam could be used to impart a snap motion to rod 70. Alternately, latch 62 could be actuated by movement of sear 32 or trigger 36.

I wish it to be understood that I do not desire to be limited to the exact details of construction shown and described for obvious modifications will occur to a person skilled in the art.

I claim:

1. In a recoil-operated gun comprising a stationary receiver having a rear end and a forward end; a bolt carrier slidable in the receiver; resilient buffer means located at the rear end of the receiver to intercept the bolt carrier as said carrier nears the end of its recoil movement; a bolt mounted on the carrier; said bolt having a front face adapted to seat against the base of a cartridge; a cartridge extractor claw swingably mounted near the front end of the bolt to engage the upper side edge of a cartridge seated on the bolt front face; a cartridge ejector rod slidably mounted on the bolt below the extractor claw to engage the cartridge base near its lower edge; said resilient buffer means including a plunger having a front face located in the path of the bolt carrier; said ejector rod being oriented so that its rear end projects rearwardly beyond the bolt carrier as the carrier nears the front face of the plunger; and manually-controllable charging means for drawing the bolt carrier rearwardly to cause the ejector rod to apply a striking force to the cartridge base and thereby eject the cartridge upwardly away from the bolt:

the improvement comprising mechanism response to motion of the charging means for increasing the striking force of the ejector rod; said mechanism comprising a piston slidably mounted alongside the receiver for movement parallel to the path taken by the bolt carrier; an ejector rod striker arm extending from the piston into a slot formed in the front face of the aforementioned plunger; spring means biasing the piston in a forward direction; a latch normally preventing the piston from advancing beyond a position wherein the striker arm surface is in the plane of the plunger front face; and means responsive to actuation of the charging mechanism for retracting the latch, whereby the piston is then spring-urged forwardly so that the striker arm applies a hammer force to the ejector rod.

2. The improvement of claim 1: the latch-retracting means being set to release the piston just prior to the instant when the rearwardly-moving ejector rod reaches the striker arm.

3. The improvement of claim 1: the charging means comprising a rotary shaft extending transversely through the receiver near its rear end; the latch-retracting means comprising a push rod engaged with the latch, and gear means driven by the shaft for moving said push rod in proportion to the shaft rotation.

4. The improvement of claim 3 wherein the gear means comprises a first bevel gear carried by the shaft, a second bevel gear meshed with the first gear, and a threaded connection between the push rod and second bevel gear.

5. The improvement of claim 1 wherein the ejector rod striker arm is configured to apply a hammer force exclusively to the ejector rod without making contact with the bolt carrier.

6. The improvement of claim 1 wherein the free end of the ejector rod striker arm projects forwardly from the general plane of the striker arm, whereby the striker arm applies a hammer force exclusively to the ejector rod prior to contact with the bolt carrier.

* * * * *